US008652379B2

(12) United States Patent
Tragant Ruano et al.

(10) Patent No.: US 8,652,379 B2
(45) Date of Patent: Feb. 18, 2014

(54) METHOD AND SYSTEM FOR MANUFACTURING HOLLOW REINFORCED CONCRETE MODULAR ELEMENTS AND ELEMENT OBTAINED THEREFROM

(75) Inventors: Jose Tragant Ruano, Cardona (ES); Miguel Morte Morales, Badalona (ES)

(73) Assignee: Compact-Habit, S.L., Cardone (ES)

( * ) Notice: Subject to any disclaimer, the term of this patent is extended or adjusted under 35 U.S.C. 154(b) by 599 days.

(21) Appl. No.: 12/865,547

(22) PCT Filed: Jan. 30, 2009

(86) PCT No.: PCT/IB2009/050376

§ 371 (c)(1),
(2), (4) Date: Sep. 16, 2010

(87) PCT Pub. No.: WO2009/095884

PCT Pub. Date: Aug. 6, 2009

(65) Prior Publication Data

US 2011/0000088 A1 Jan. 6, 2011

(30) Foreign Application Priority Data

Feb. 1, 2008 (ES) ..... 200800263

(51) Int. Cl.

| | |
|---|---|
| ***B28B 23/02*** | (2006.01) |
| ***E04B 1/16*** | (2006.01) |
| ***B28B 3/00*** | (2006.01) |
| *B28B 7/04* | (2006.01) |
| *B28B 7/22* | (2006.01) |
| *E04G 11/02* | (2006.01) |

(52) U.S. Cl.

USPC ..... 264/253; 264/31; 264/33; 264/34; 264/35; 264/250; 264/251; 264/255; 264/333

(58) Field of Classification Search

USPC ..... 264/319, 333, 334, 31, 33, 34, 35, 250, 264/251, 253, 55; 249/13, 26, 27, 170, 171; 52/79.14, 106; 425/442

See application file for complete search history.

(56) References Cited

U.S. PATENT DOCUMENTS

| | | | | |
|---|---|---|---|---|
| 1,276,624 | A | 8/1918 | Cummings | |
| 1,581,797 | A * | 4/1926 | Fey | 249/172 |

(Continued)

FOREIGN PATENT DOCUMENTS

| | | |
|---|---|---|
| DE | 3203107 | 8/1983 |
| NL | 8502696 | 5/1987 |

(Continued)

OTHER PUBLICATIONS

International Search Report for PCT/IB2009/050376 completed Oct. 7, 2007.

*Primary Examiner* — Atul P. Khare
(74) *Attorney, Agent, or Firm* — Barnes & Thornburg LLP

(57) ABSTRACT

Method for manufacturing modular, hollow, prismatic, monolithic reinforced-concrete elements of rectangular section, which includes the stages of concreting their side walls in two horizontally arranged formwork structures, carrying out a rotation of said formwork structures so as to leave them arranged vertically on either side of a third formwork, with said third formwork horizontal, then concreting the floor slab, placing formwork between the side walls for concreting of the ceiling slab and withdrawing the modular element, so that a high degree of monolithism is achieved, a method in which all the concretings are carried out in the horizontal, and precise control is achieved over the measurements of the element obtained.

5 Claims, 3 Drawing Sheets

(56) References Cited

U.S. PATENT DOCUMENTS

| | | | | |
|---|---|---|---|---|
| 3,932,082 | A | 1/1976 | Beaman | |
| 4,207,042 | A | 6/1980 | Linetsky | |
| 4,799,982 | A * | 1/1989 | Vicino | 156/71 |

FOREIGN PATENT DOCUMENTS

| | | | |
|---|---|---|---|
| SU | 1722843 | A1 * | 3/1992 |
| SU | 1717368 | | 7/1992 |
| WO | W095/13172 | | 5/1995 |

* cited by examiner

Fig. 1.a
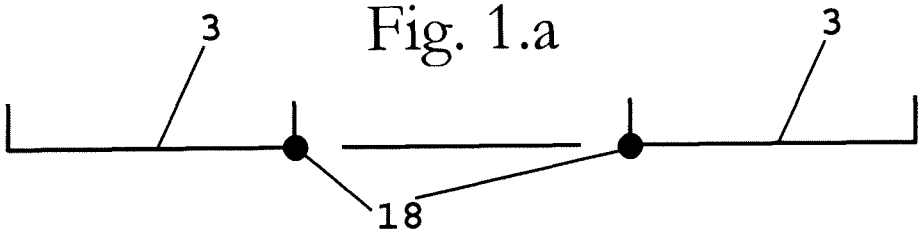
Fig. 1.b
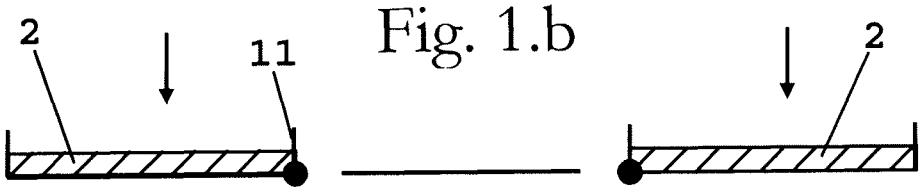
Fig. 1.c
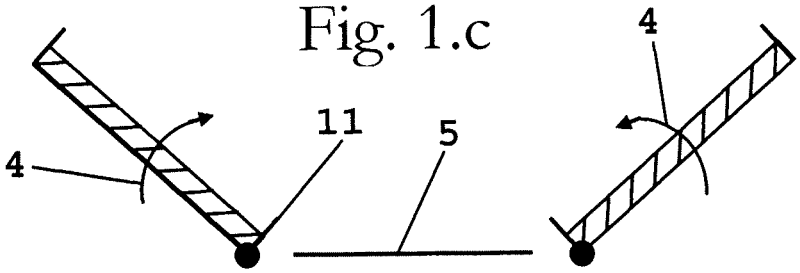
Fig. 1.d
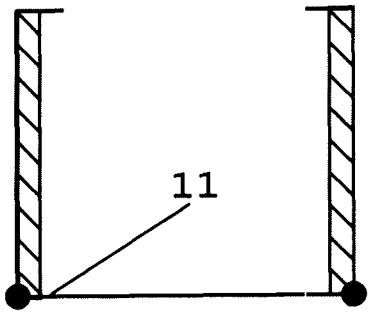

Fig. 1.e
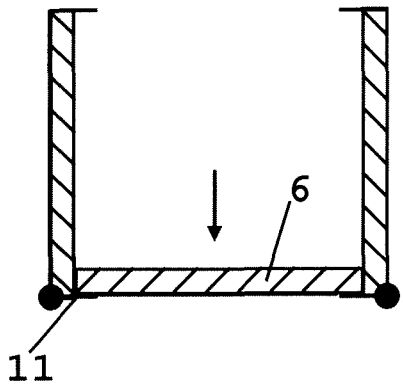
Fig. 1.f
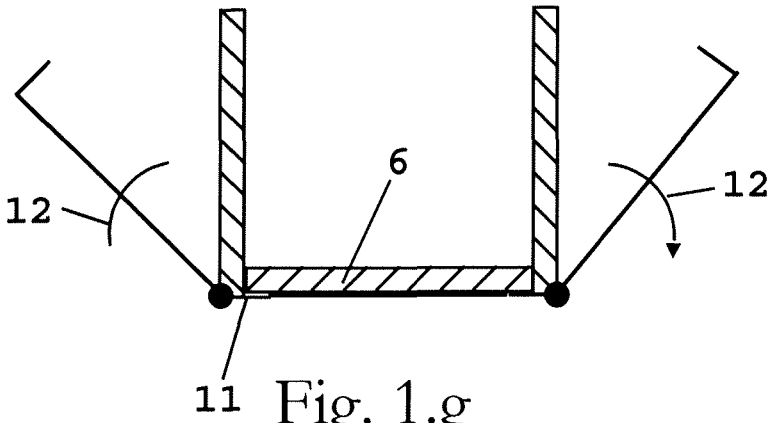
Fig. 1.g
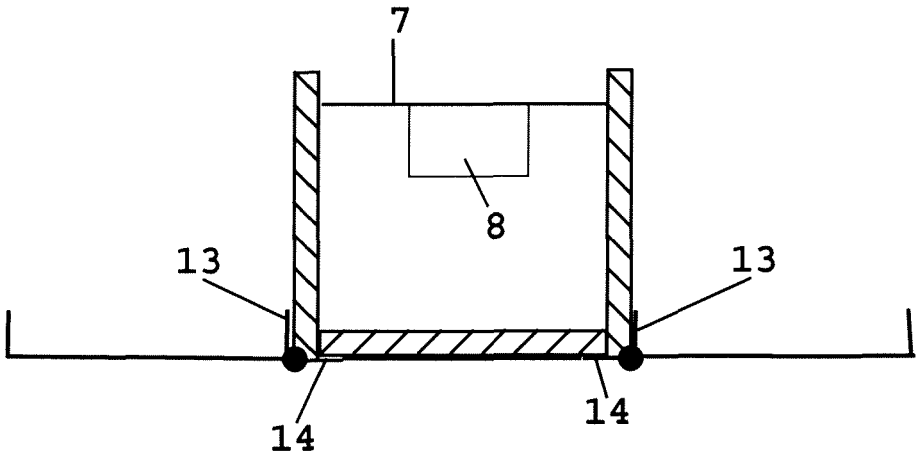

Fig. 1.h
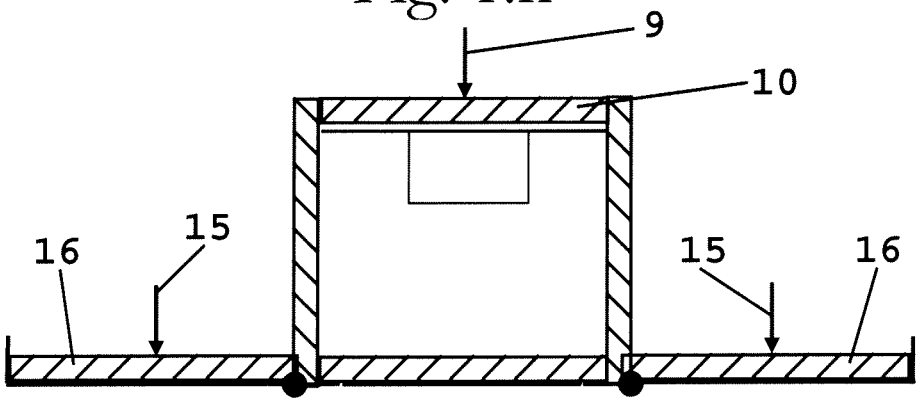
Fig. 1.i
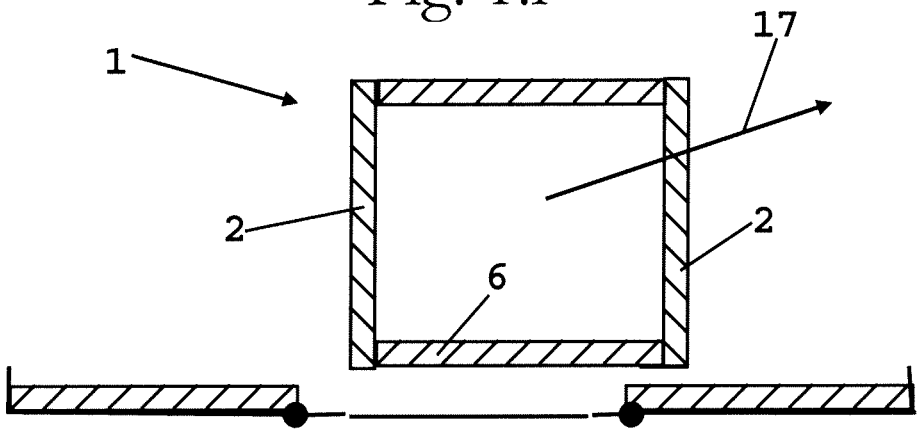

METHOD AND SYSTEM FOR MANUFACTURING HOLLOW REINFORCED CONCRETE MODULAR ELEMENTS AND ELEMENT OBTAINED THEREFROM

CROSS-REFERENCE TO RELATED APPLICATIONS

This application is a U.S. national counterpart application of International Application Serial No. PCT/IB2009/050376 filed Jan. 30, 2009, which claims priority to Spanish Patent Application No. P 200800263 filed Feb. 1, 2008. The disclosures of PCT/IB2009/050376 and P 200800263 are hereby incorporated herein by reference.

The present invention relates to a method for manufacturing monolithic construction elements and to an installation for carrying out the aforesaid method, which permit mass manufacturing with optimum tolerance control of light modular construction elements of high structural strength, while optimising manufacturing times and costs.

BACKGROUND OF THE INVENTION

Known in the art is the mass-manufacturing of hollow, prismatic, monolithic reinforced-concrete construction elements of rectangular section for building stackable dwellings, such that it is possible to construct buildings from factory-made elements.

"Monolithic construction element" is taken to mean an element that is homogeneous from the point of view of the material composing it. In this respect, it is possible to conceive of several degrees of monolithism, which will be greater the greater the homogeneity that is achieved in the element.

This monolithism will be associated with greater structural strength, for the greater the monolithism is the fewer joints the element will have and, in general, the fewer weak spots.

In its patent ES 2 285 877 the applicant, with experience in the specific sector of modular construction elements manufacturing, describes a method for manufacturing modular elements that uses four prefabricated reinforced-concrete panels that will make up the four walls, sides, bottom and top, these last also called "floor slab" and "ceiling slab" respectively, of the prefabricated element. More specifically, this patent claims a preferred embodiment in which the prefabricated modular elements are obtained by attaching the aforesaid four walls to two steel frames. Although it is not mentioned in the patent, the four panels are made using a method known in the sector, by formworking on horizontal tables, for which purpose a self-compacting concrete can be used. Concreting on horizontal tables is essential for obtaining the utmost homogeneity of the panel so obtained, since the cement does not have to travel great distances, and the method also avoids disintegration due to vertical drop. Self-compacting concrete is taken to mean a concrete with fluidity characteristics.

However, although in this technique described each panel is homogeneous and can have high strength, the product so obtained is not monolithic, since all the joints at the edges are made once the panels have already been made. Similarly, although stabilisation and union by means of said frames has given satisfactory results, it does involve joints made after the various panels have set, and is therefore not optimum from the standpoint of overall monolithism, since the rigidity of the whole is mainly concentrated in the frames.

Besides, there already exist methods that permit relatively monolithically manufactured elements to be obtained. The most common is casting or concreting in fixed formwork during the process, with the final prismatic shape of said element. The concreting will thus inevitably be implemented in the vertical plane for the walls of the formwork that are mounted vertically, and this will give rise to disintegration of the concrete owing to the considerable distance that it has to travel.

This last disadvantage is aggravated when the aim is to obtain reinforced elements with thin walls, as the passage section for the liquid concrete is reduced, and it also comes up against the reinforcing bars already arranged in the formwork, thereby making the formation of blowholes/honeycombing in the end product highly likely, in addition to a probable lack of homogeneity of the material making it up. And this disadvantage is obviously rendered more acute when the dimensions of the final product are increased.

Another disadvantage of fixed formwork is the difficulty, where setting permits, of withdrawing the moulds that compose the formwork, particularly the interior ones.

Another solution is to use a rotating formwork, which allows successive formworking in the horizontal plane of the various walls by rotating the drum that contains the formwork. However, although this solution does allow a high degree of monolithism to be achieved, it also presents the following disadvantages:

- The device is complex, since it calls for a large structure capable of driving a large mass in rotation. This therefore constitutes a clear limitation as regards the maximum dimensions of the element obtained.
- Only elements of a single dimension can be obtained, so the method is not very versatile from the point of view of the product, unless additional moulds or fillers are employed.
- Although it does allow mass-manufacturing of elements, the total manufacturing time of an element is about four times as long as the minimum setting time needed for each of the four walls of the element.
- It presents problems of stripping (removal of formwork) when the element needs ribs, a necessary condition for any stackable modular system due to issues of making it lighter. In this respect the utilisation of added moulds which are removed once the piece has been withdrawn from the drum has been proposed. But this solution involves an added cost in auxiliary elements, in processing time and problems of tolerances, since the introduction of further stages and auxiliary elements inevitably gives rise to positioning errors.

Other related inventions are disclosed in WO 9513172 A1 relating to a "Method of Manufacturing precast concrete units", U.S. Pat. No. 4,207,042 A relating to a "Casting and erecting machine" and SU 1717368 A1 relating to a "Plant for manufacturing monolith volumetric products."

It should be noted that the control of tolerances and measurements in the manufacturing processes described is limited, since in all cases there are many moving parts and manufacturing stages. This clearly limits the maximum number of floors that a building made by stacking of applicable modular elements can have. It is thus not obvious in this sector of the art that a method could be made available that permits modular construction elements such as those described to be obtained, having a high degree of monolithism and that can be mass-manufactured within an optimum time and with strict control of tolerances.

DESCRIPTION OF THE INVENTION

With the method and the installation of the invention, the applicant proposes a solution to the disadvantages described, while moreover providing additional advantages and characteristics that will be described below.

The method of the invention for manufacturing hollow, prismatic, monolithic, modular reinforced-concrete elements of rectangular section is characterised in that it includes the stages of:

a) concreting the side walls of the modular element in two horizontally arranged formworks,
b) after sufficient setting of the side walls, carrying out a rotation of said formwork structures so as to leave them arranged vertically on either side of a third formwork, which third formwork is horizontal, and,
c) concreting the floor slab of the element on said third formwork,
d) placing formwork between the side walls, sustained at the right height for concreting the ceiling slab of the element,
e) concreting the ceiling slab of the element, and,
f) withdrawing the modular element from the third formwork when setting so permits.

With this method the proposed objectives are achieved, namely:

A high degree of monolithism is achieved, for partial setting of the side walls at the time the formwork of the floor and ceiling slabs is made allows strongly attached union joints between walls and slabs to be achieved. This monolithism is assisted by the fact that all four joints are made at practically the same moment, since stages c) and d) are of negligible duration in relation to the subsequent setting of the slabs and, therefore, of the joints the latter form with the side walls.

A method is achieved in which all the concreting operations are carried out in a horizontal plane, thus minimising movement of the concrete, preventing disintegration, permitting it to reach all points and thereby achieving considerable homogeneity of the product so obtained. This allows low wall thicknesses to be obtained, even despite the presence of a reinforcement structure.

Precise control is achieved over the measurements of the element obtained, since the only movement in the formworking process is the rotation of the side walls about a fixed axis. This allows elements with precise dimensions to be achieved, a characteristic that is essential to ensure great stacking strength of elements and a high degree of predictability in response to stresses.

The process described thus achieves an element of considerable homogeneity of the material composing it, and one that is very robust, slender and with optimum control of tolerances.

All these characteristics make it particularly suitable for the construction of buildings by stacking of these elements, since:

Their slenderness ensures a minimum weight of each element.

Their robustness allows the structural strength of the elements to be guaranteed, which combined with their minimum weight allows buildings of up to six storeys or even more to be made.

The control of the measurements of the elements is another essential characteristic for achieving high structural strength, since its helps prevents maladjustments in the relative arrangement of the elements and therefore avoids an accumulation of maladjustments as further floors are added.

Furthermore, in relation to the state of the art, fewer movements are made and they are also minimal in order to obtain a monolithic element. This fact, together with automation of the process, reduces working risks involved in handling loads.

Preferably, the concreting of the ceiling slab is carried out immediately after completing concreting of the floor slab, so that the upper and lower joints set at the same time, thus permitting great homogeneity of the product.

Advantageously, after stage b) the formwork structures of the side walls are arranged horizontally again in order to restart manufacturing of another element, so that they become available to begin manufacturing another element. This allows usage of the installation to be optimised and manufacturing times reduced.

The invention likewise relates to an installation that enables implementation of the method described, and more specifically to an installation for the manufacturing of hollow, prismatic, monolithic reinforced-concrete modular elements of rectangular section, which include two formwork structures for concreting the side walls, one formwork for concreting of the floor slab and another formwork for concreting of the ceiling slab, and which is characterised in that each one of the formwork structures for concreting the side walls is articulated about a horizontal axis in such a way that they can rotate from a horizontal concreting position to a vertical position, thus making the formwork of the floor slab of the modular element.

This installation permits precise control of manufacturing tolerances, for there are only three moving parts during the manufacturing process: rotation of the side formwork structures and shifting insertion of the ceiling slab formwork.

The aforesaid rotation movements obviously take the element to its definitive position inside the element itself, for which reason in the method of the invention the stage following the rotation of the side walls (formworks) is concreting of the floor slab. For this reason it is likewise obvious that after the rotation the edges of the formwork of the side walls coincide with the lateral edges of the floor slab formwork, which will also be called bottom platform.

It likewise permits stripping in several stages, particularly permitting stripping of the side walls when they are partially set, only in so far as necessary to allow the element to be placed vertically without it deforming. This partial setting is what allows the joints that will be in contact with the floor and ceiling slabs to set with said floor and ceiling slabs.

More preferably, the formwork structures of the side walls include a bottom platform limited by lateral flanges, and is characterised in that the lateral flange near said axis is articulated with said platform, in such a way that the lateral formwork structures can be withdrawn by rotation. During the formwork, these flanges are part of the formwork, and further become, following rotation of the element, the vertical supports of the element. In order to be able to remove the lateral formwork structures it is therefore necessary for these lateral flanges to be detachable under rotation from the main surface of the lateral formwork.

Moreover, this articulation permits the placement of a second lateral flange arranged perpendicularly to said flange, so that the formwork of the side walls of the following element can be made.

More advantageously, the horizontal articulation axes are movable horizontally, such that the installation allows elements of different widths to be obtained. Similarly, the length of the elements obtained can be adjusted.

Finally, the invention relates to the hollow, prismatic, monolithic reinforced-concrete element of rectangular section obtained by the method and the installation described.

BRIEF DESCRIPTION OF THE DRAWINGS

For a better understanding of all that has been set out some drawings are attached which, schematically and solely by way of non-restrictive example, show a practical case of embodiment of the method of the invention with the installation of the invention. These drawings show the successive stages of the method through the arrangement of the main elements that make up the installation viewed in section, which means that the longitudinal axis of the prefabricated element is perpendicular to the plane of the sheet of paper. More specifically:

FIG. 1.*a* shows the relative arrangement of the formwork structures of the side walls and the formwork of the floor slab at the initial moment.

FIG. 1.*b* shows the end of the stage of concreting the side walls.

FIG. 1.*c* shows a moment in the stage of raising the side walls to vertical, once they have set sufficiently to prevent them from deforming in excess of the maximum tolerances admissible in the final product.

FIG. 1.*d* shows the relative arrangement of the elements at the end of the rotation movement.

FIG. 1.*e* shows the end of the stage of concreting the floor slab of the element.

FIG. 1.*f* shows the descending movement of the formwork of the side walls.

FIG. 1.*g* shows the installation once the lateral formwork structures are back in horizontal position and once the formwork of the ceiling slab has been put in place.

FIG. 1.*h* shows the installation once the ceiling slab of the element has been formworked and the side walls of the following element have been formworked.

FIG. 1.*i* shows the installation once the formwork has been removed and, following sufficient setting of the element, its removal from the installation has started.

DESCRIPTION OF A PREFERRED EMBODIMENT

According to a preferred embodiment, the method object of the invention for the manufacturing of hollow, prismatic, monolithic modular reinforced-concrete elements of rectangular section 1 includes the following stages:

In a first phase, whose beginning and end are shown in FIGS. 1.*a* and 1.*b* respectively, the concreting (formwork) of the side walls 2 of said element is carried out in two formwork structures 3 arranged horizontally, thus permitting an optimum concreting from the viewpoint of homogeneity of the material to be assured. This horizontal concreting allows walls of up to some 50 mm and of great mechanical strength to be obtained, thereby making them very thin and of minimum weight, which characteristic permits multi-floor stackings to be achieved with the modular elements obtained.

According to a preferred embodiment of the invention, the rotation axes 18 of the installation are horizontally moveable, thereby allowing the installation to be prepared for the manufacturing of modules of different sizes, and especially of different widths. In this case, allowance is made for the placement of additional formwork elements in order to vary the width of the floor slab formwork 5.

After the side walls 2 have set sufficiently, the formwork structures of the side walls are given (FIG. 1.*c*) a rotation 4 to take them to the vertical position shown in FIG. 1.*d*. Sufficient setting is naturally taken to mean a degree of setting that allows the aforesaid rotation to be carried out without deforming the element.

It must be stressed that the ninety-degree rotation carried out takes the side walls to their definitive relative position in the element 1, such that no further movements of said walls will be required until the element has been completed.

Since, as has just been noted, the rotation takes the side walls to their final position in the element, the lower ends of the side walls 2, together with the bottom 5, make up the formwork of the floor slab 6. FIG. 1.*e* shows the end of the process of concreting the formwork of the floor slab, which is carried out before the walls 2 have set completely, so that the setting of the joining ribs 7 between the floor slab 6 and the walls 2 leads to a close joint at those points. This close joint greatly contributes towards the monolithism of the element.

Once concreting of the floor slab has been carried out, or even before that where the setting so permits, the formwork structures of the side walls can be moved to their horizontal position, FIG. 1.*f*, so that the element is left stripped along its sides, and thus left ready for the formwork of the side walls for another element.

As provided for in the invention, however, this stripping rotation is only possible if the side walls 11, also called flanges, have first been detached under rotation from the lateral formwork structures 2. Attaching and detaching of these flanges can be carried out by means of a system of pins that are inserted or withdrawn respectively, for example, along the articulation axis between the lateral formwork 2 and said flanges 11. It can thus be appreciated that the dimensioning of the lateral formwork structures and said flanges, as well as the positioning of these elements in the installation, are especially critical, since they will contribute greatly to control of the dimension tolerances of the element obtained.

It should also be noted that the lateral flanges have a dual function. On the one hand they make up some of the perimetral surfaces of the side wall formwork and, when the formwork (the wall) is placed vertically, serve to support the wall.

The formwork 7 of the ceiling slab is then inserted in a longitudinal direction, i.e. perpendicularly to the plane of the sheet, sustained by a moving structure 8, and then raised up to the right position for concreting 9 of the ceiling slab 10, as shown in FIG. 1.*h*.

It should be stressed that one of the advantages of the invention is that it allows the usage of all the formwork structures to be optimised.

Indeed, it can be appreciated from FIG. 1.*g* that the lateral formwork structures 3 are already left free for concreting the side walls 2 of the next element to be manufactured.

However, since for carrying out the rotation 12 towards the horizontal position it has been necessary to detach the lateral flange of the formwork, installation by means of the system of pins mentioned above makes provision for introducing another set of flanges 13 arranged largely perpendicular to the flanges 14 that are implementing the supporting function at that time, as shown in FIG. 1.*g*.

To return to FIG. 1.*h*, with these new flanges the concreting 15 of the side walls 16 of the next element to be manufactured can already be carried out.

Finally, as shown in FIG. 1.*i*, following a degree of setting sufficient to allow the element 1 to be raised or manipulated for transfer 17 thereof, the latter is removed from the installation in order to pass on to subsequent manufacturing stages, leaving the central platform free to carry out raising in rotation of the lateral formwork structures, thereby returning to the stage described in FIG. 1.*b*.

What is claimed is:

1. A method of manufacturing a hollow, monolithic, concrete modular element, the method comprising the steps of:

concreting first and second side walls in first and second formworks arranged horizontally;

rotating the first and second horizontally arranged formworks while said concreted side walls are in a partially set state so as to arrange the side walls vertically on opposite sides of a third formwork arranged horizontally, the vertically arranged side walls having lower ends constituting part of said third formwork;

concreting a floor slab in said third formwork after said rotating and before the side walls have completely set, the concreted floor slab forming lower joints with said side walls;

positioning a fourth formwork arranged horizontally between the vertically arranged side walls at a height suitable for concreting a ceiling slab, the vertically arranged side walls having upper ends constituting part of said fourth formwork;

concreting a ceiling slab in said positioned fourth formwork after concreting the floor slab and before the side walls and floor slab have completely set, the ceiling slab forming upper joints with said side walls; and forming said monolithic element by concurrently setting the concreted floor and ceiling slabs together with the partially set side walls.

2. The method of claim 1, wherein said monolithic element comprises a rectangular cross-section.

3. The method of claim 1, wherein said monolithic element comprises reinforced concrete.

4. The method of claim 1, wherein the ceiling slab is concreted immediately after completing concreting of the floor slab.

5. The method of claim 1, further comprising arranging the first and second formworks horizontally again, after said rotating, in order to permit concreting of side walls for another monolithic element.

* * * * *